US005586547A

United States Patent [19]

Nixon

[11] Patent Number: 5,586,547

[45] Date of Patent: Dec. 24, 1996

[54] INSTANTANEOUS GAS WATER HEATER

[76] Inventor: Austin D. Nixon, 1500 Airway Cir., New Smyrna Beach, Fla. 32168

[21] Appl. No.: 372,500

[22] Filed: Jan. 13, 1995

[51] Int. Cl.[6] ..... F24H 1/00

[52] U.S. Cl. ..... 126/351; 431/329; 431/90; 126/361; 126/391; 122/55; 122/13.1; 122/44.2

[58] Field of Search ..... 126/362, 361, 126/391, 351, 360 R; 122/55, 367.2, 367.3, 135.3, 155.2, 44.2, 44.9, 13.1, 19, 136 R; 431/90

[56] References Cited

U.S. PATENT DOCUMENTS

| | | | |
|---|---|---|---|
| 3,221,799 | 12/1965 | Hamelink et al. | 431/31 |
| 3,425,675 | 2/1969 | Twine | 431/328 |
| 3,477,411 | 11/1969 | Gething | 122/135.1 |
| 3,744,954 | 7/1973 | Faulkner | 431/31 |
| 3,975,140 | 8/1976 | Placek | 431/329 |
| 4,371,779 | 2/1983 | Maynard et al. | 237/8 A |
| 4,380,215 | 4/1983 | Mendelson | 122/44.2 |
| 4,383,820 | 5/1983 | Camacho | 431/265 |
| 4,395,976 | 8/1983 | de Lallee et al. | 122/367.3 |
| 4,501,261 | 2/1985 | Tsusui et al. . | |
| 4,550,689 | 11/1985 | Wolter . | |
| 4,585,161 | 4/1986 | Kusama et al. | 431/90 |
| 4,604,515 | 8/1986 | Davidson . | |
| 4,746,287 | 5/1988 | Lannutti | 431/328 |
| 4,808,793 | 2/1989 | Hurko . | |
| 5,020,127 | 5/1991 | Eddas et al. . | |
| 5,203,689 | 4/1993 | Duggan et al. | 126/361 |
| 5,470,223 | 11/1995 | McCoy | 431/74 |
| 5,486,107 | 1/1996 | Bonne | 431/90 |

OTHER PUBLICATIONS

*Gas Ignition Systems Catalogue* (Channel Products Inc. Short Form Catalogue No. 19913, Sep. 1992) pp. 1,4,9,23, 41.

*Micro Pneumatic Logic, inc. Catalogue* (Micro Pneumatic Logic, inc., 1994) pp. 1,8,9.

*WCF Gas Fired Infra–Red Power Burners* Descriptive Bulletin (Solaronics, Inc., 1994) p. 1.

*Gas Fired Infra–Red Burner Design Considerations and Overview* (6 Farshid Ahmady, Solaronics, Inc., 1994) pp. 449,455.

*Solaronics, Inc. Drawing* No. B–0800–20–709 Rev. Dec. 21, 1994, Solaronics, Inc.

*Primary Examiner*—Carroll B. Dority

*Attorney, Agent, or Firm*—Paul S. Rooy

[57] ABSTRACT

An instantaneous gas water heater comprising a control panel, a heat transfer section, and a blower section. The control panel includes an electronic controller, a gas solenoid valve, and a means to prove the operation of a blower. The heat transfer section comprises an inner jacket enclosing a combustion chamber and an outer jacket enclosing the inner jacket. The combustion chamber contains an ignition means, a combustion means, and a baffle. In the preferred embodiment the combustion means was a powered burner comprising a venturi tube with venturi tube holes, and a woven ceramic fabric mantle containing the venturi tube. The baffle is made up of a spine, consecutive ribs attached to the spine, spine holes in the spine disposed between the ribs, and rib holes in the ribs, the rib holes being disposed in consecutive ribs on alternating sides of the spine. The blower section includes a blower communicating with the combustion chamber through a gas/air mixing chamber.

17 Claims, 5 Drawing Sheets

INSTANTANEOUS GAS WATER HEATER

BACKGROUND OF THE INVENTION

1. Field of the Invention

This invention relates to water heaters, and in particular to an instantaneous gas water heater.

2. Background of the Invention

One of the more important milestones in the evolution of mankind has been the development of delivery systems for on-demand hot water. The advantages and utilities of on-demand hot water are numerous: the ability to wash effectively before eating and at other times during the day has enhanced man's ability to avoid diseases; cooks are able to accelerate cooking chores involving hot water by starting out with pre-heated water; and the task of washing eating and cooking utensils, and other household items, has been rendered more effective and efficient through the use of readily available hot water, thus decreasing disease transmittal. High temperature hot water may be provided at the kitchen sink for immediate use in hot beverage preparation. The very existence of commercial and residential automatic dishwashers depends on hot water heaters. These are only a few examples of hot water heater use—myriad other important uses exist in residential, commercial, and industrial settings.

The most common water heater design comprises a relatively large tank which holds water whose heating may have taken hours. If more hot water is used than is in the tank, the outlet water temperature drops dramatically because office low heating rate of these systems. Since the tank loses heat to the ambient, the water must be re-heated periodically, thus wasting energy. Therefore, currently available tank hot water systems may run out of hot water, and waste energy.

One solution to the problems associated with tank hot water heating systems is the instantaneous hot water heater. Instantaneous water heating systems heat water at a much higher rate than tank systems, thereby avoiding the need to store hot water in a tank. Instantaneous water heating systems transfer heat to water only when a demand for hot water is sensed, and then heat the water at a rate sufficient to provide hot water at the same rate as the hot water is being consumed.

Existing Designs

A number of patents have been granted for instantaneous water heaters. U.S. Pat. Nos. 4,604,515, 4,808,793 and 5,020,127 were granted to Davidson, Hurko and Eddas et al. respectively. While these water heaters provided on-demand hot water without the use of a hot water storage tank, these designs incorporated electric heating elements to provide the heat with which to heat the water. Therefore these designs suffered from the problem that natural or low pressure ("LP") gas could not be used to heat the water. In many areas gas is the preferred energy source for water heating due to its low cost and clean combustion characteristics. In addition, electricity is not available in some locations, rendering the use of these electric designs impossible.

U.S. Pat. No. 4,550,689 was granted Wolter for a Gas Instantaneous Water Heater. While this design used gas as the energy source with which to heat water, it suffered from a number of disadvantages. First, the design incorporated three atmospheric burners. The atmospheric burner is the traditional design of choice for gas heaters. In this type of burner, the gas is injected via an orifice into the opening of a venturi, inspirating the air required for combustion to the burner. The air is proportional to the input rate of the burner.

Atmospheric burners are used in applications where the back pressure from the flue gasses is minimal and the venturi is capable of providing enough air flow for combustion. However, atmospheric burners suffer from efficiency decreases where the combustion chamber is enclosed and the heated surface is very close to the burning surface (which is the situation in most instantaneous gas water heaters). Under these conditions, a relatively large back pressure is developed by the flue gases, and the venturi used in atmospheric burners is not capable of overcoming the back pressure. In these situations, powered burners are quickly becoming the system of choice.

In a powered burner, the air is supplied to the burner by a mechanical means such as a fan or blower. The current low price and availability of blowers render the powered burner a competitively priced design. The efficiencies of powered burners are higher than these of the atmospheric burner due to increased flue gas velocities. And the design of heat exchangers incorporating powered burners can be more flexible by eliminating concerns of restricting the combustion air.

Second, the multiplicity of burners (three) and serpentine coilings render the Wolter design complex, with attendant cost impact. Finally, the water to be heated does not completely surround the burners, thereby causing energy loss between the coils, negatively affecting heating efficiency.

U.S. Pat. No. 4,501,261 was granted Tsutsui et al. for art Instantaneous Gas Water Heater. While this design used gas for energy, the design was rendered complex through the use of a fan damper which variably adjusted the size of an air supply opening to the combustion chamber, through the incorporation into the design of variable pitch spacing fins on the outer surface of the heat exchange pipe, and through the use of a water flow sensor comprising a vane wheel, magnet and sensor element. These complexities contributed to the cost of the unit. In addition, this design used a two dimensional burner, which only burned gas in a horizontal plane. Therefore the heat transfer efficiency was not as great as if a three dimensional burner were used. The heat transfer rate was further compromised because this design employed only a single trip by the hot air past the heat exchange pipe. Finally, no heat absorbing layer was disclosed on the heat exchanger pipe or fins, thereby reducing the heat transfer efficiency.

SUMMARY OF THE INVENTION

Accordingly, it is an object of the present invention to provide an instantaneous gas water heater which uses gas as an energy source. Design features allowing this object to be accomplished include an electronic controller, a gas solenoid valve, a gas/air mixing chamber, and a powered burner. Advantages associated with the accomplishment of this object include low cost, the virtually universal availability of gas, and clean combustion characteristics.

It is another object of the present invention to provide an instantaneous gas water heater whose burner features a three-dimensional, cylindrically shaped heating area. Design features allowing this object to be accomplished include a powered burner comprising a venturi tube with venturi tube holes surrounded by a cylindrically shaped mantle. Benefits associated with the accomplishment of this object include increased heating efficiency, and attendant lower gas consumption, with consequent cost and resource savings.

It is another object of this invention to provide an instantaneous gas water heater incorporating a heat absorbing layer to increase the heat transfer rate. Design features enabling the accomplishment of this object include an inner jacket with a coating of heat absorbing pigment such as black high-temperature paint. Advantages associated with the realization of this object include increased heating efficiency, and attendant lower gas consumption, with consequent cost and resource savings.

It is still another object of this invention to provide an instantaneous gas water heater whose heated air comes into contact with heat transfer surface multiple times. Design features allowing this object to be achieved include a baffle encased within an inner jacket. Benefits associated with reaching this objective include increased heating efficiency, and attendant lower gas consumption, with consequent cost and resource savings.

It is a further object of this invention to provide an instantaneous gas water heater incorporating a powered burner. Features permitting this object to be accomplished include a blower, an electronic controller, a gas/air mixing chamber, and a powered burner. Benefits associated with the achievement of this object include increased heating efficiency, and a compact, space-saving design.

BRIEF DESCRIPTION OF THE DRAWINGS

The invention, together with the other objects, features, aspects and advantages thereof will be more clearly understood from the following in conjunction with the accompanying drawings.

Five sheets of drawings are provided. Sheet one contains FIG. 1. Sheet two contains FIG. 2. Sheet three contains FIG. 3. Sheet four contains FIGS. 4 and 5. Sheet five contains FIG. 6.

DETAILED DESCRIPTION OF THE PREFERRED EMBODIMENT

Figure 1:
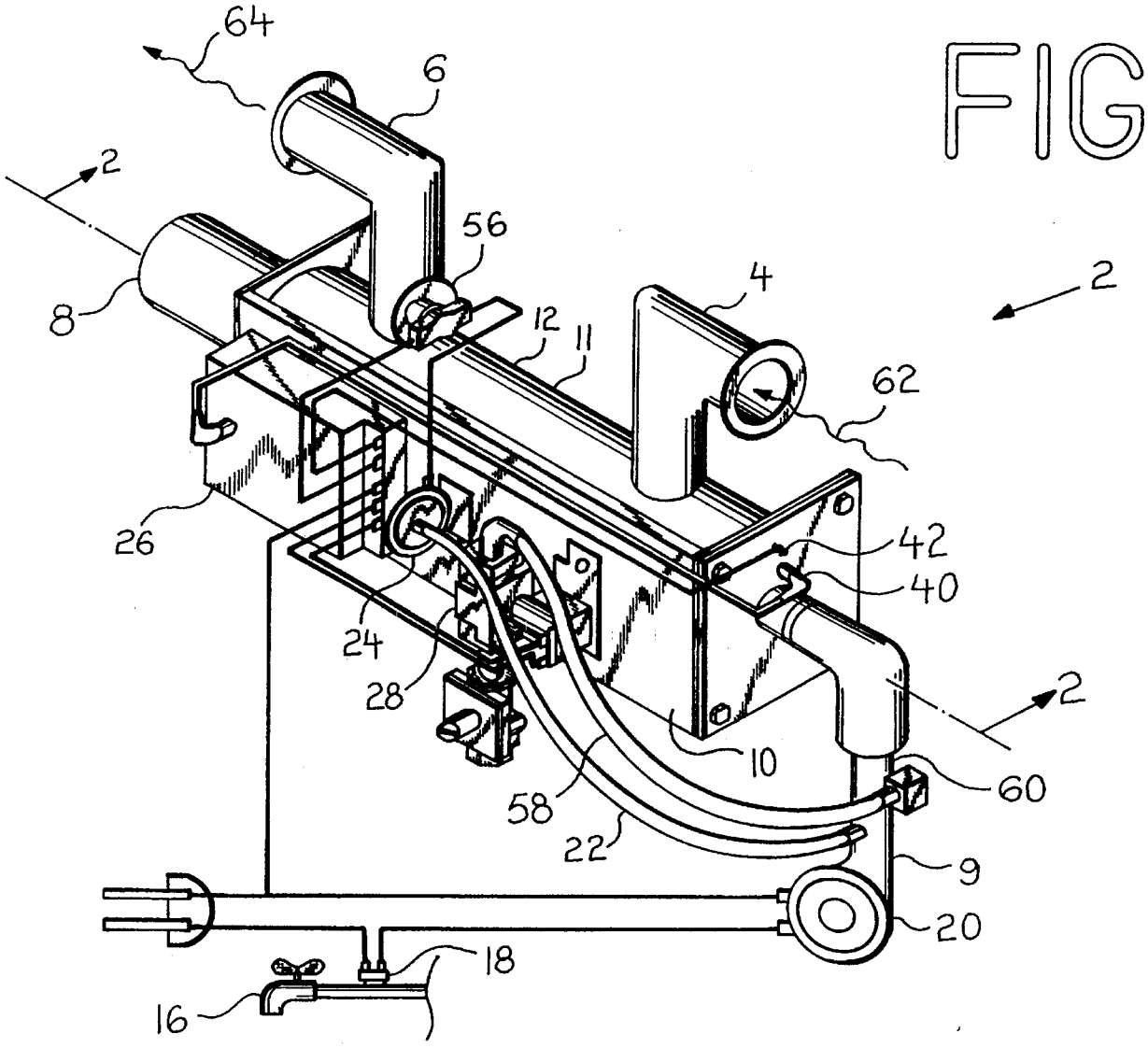
FIG. 1 is a from isometric view of an instantaneous gas water heater.

FIG. 1 is a front isometric view of instantaneous gas water heater 2. Control panel 10 and blower section 9 are attached to heat transfer section 11. Control panel 10 comprises electronic controller 26, air flow switch 24, and gas solenoid valve 28. Blower section 9 comprises blower 20 and gas/air mixing chamber 60. Air flow switch 24 and gas solenoid valve 28 communicate with gas/air mixing chamber 60 through tube 22 and gas line 58 respectively. Gas solenoid valve 28 is connected to a gas supply.

Figure 2:
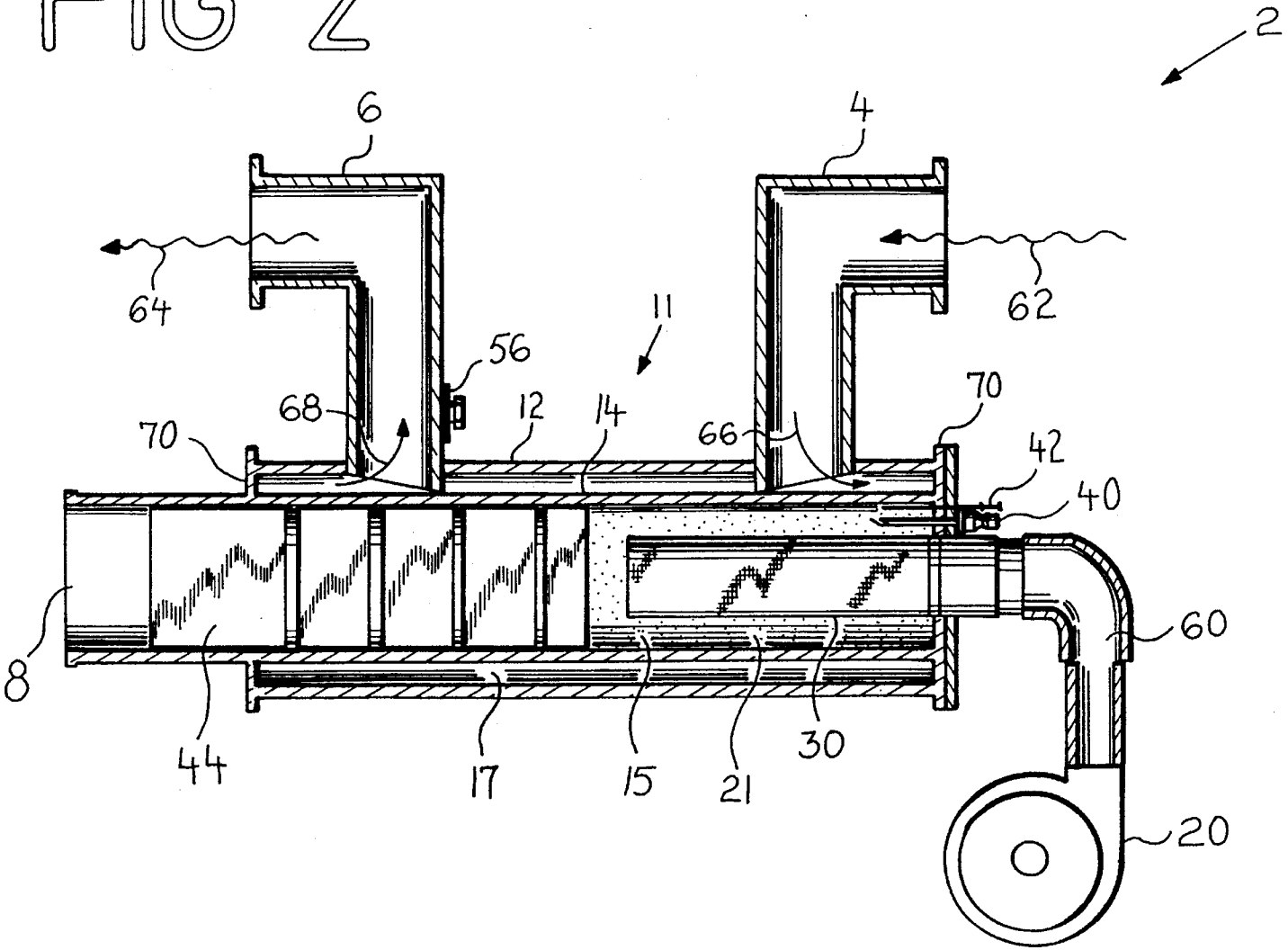
FIG. 2 is a front cross-sectional view of an instantaneous gas water heater taken at section 2—2 of FIG. 1.

FIG. 2 is a front cross-sectional view of instantaneous gas water heater 2 taken at section 2—2 of FIG. 1. Referring now also to FIG. 2, heat transfer section 11 comprises water inlet 4 which communicates with water outlet 6 through water sleeve 17. Water sleeve 17 is defined by the space between outer jacket 12 and inner jacket 14. The space inside inner jacket 14 defines a combustion chamber 21. Endplates 70 may be used to hold outer jacket 12 and inner jacket 14 in position relative to each other, and to constrain water within water sleeve 17. Spark ignitor 40, flame sensor 42, powered burner 30, combustion chamber 21, and baffle 44 are disposed within combustion chamber 21. The inside of inner jacket 14 is coated with heat absorbing layer 15.

In operation, faucet 16 communicating with water outlet 6 is opened, thereby closing water pressure switch 18, which sends electrical power to blower 20 and electronic controller 26. Electronic controller 26 then opens gas solenoid valve 28 and instructs spark ignitor 40 to start combustion at powered burner 30. The fact that the instant design incorporates a powered burner 30 (as opposed to a less efficient atmospheric burner), a three-dimensional cylindrically shaped powered burner 30 (as opposed to a two-dimensional burner), heat absorbing pigment 15, and baffle 44 (which causes heated air to contact heat transfer surfaces multiple times) substantially increases the heat transfer efficiency of heat transfer section 11.

Ambient temperature water inflow 62 enters water sleeve 17 via water inlet 4 as indicated by arrow 66, is heated via forced convection by the heat transferred to inner jacket 14 from powered burner 30 and baffle 44, and exits water sleeve 17 as hot water outflow 64 as indicated by arrow 68.

Figure 6:
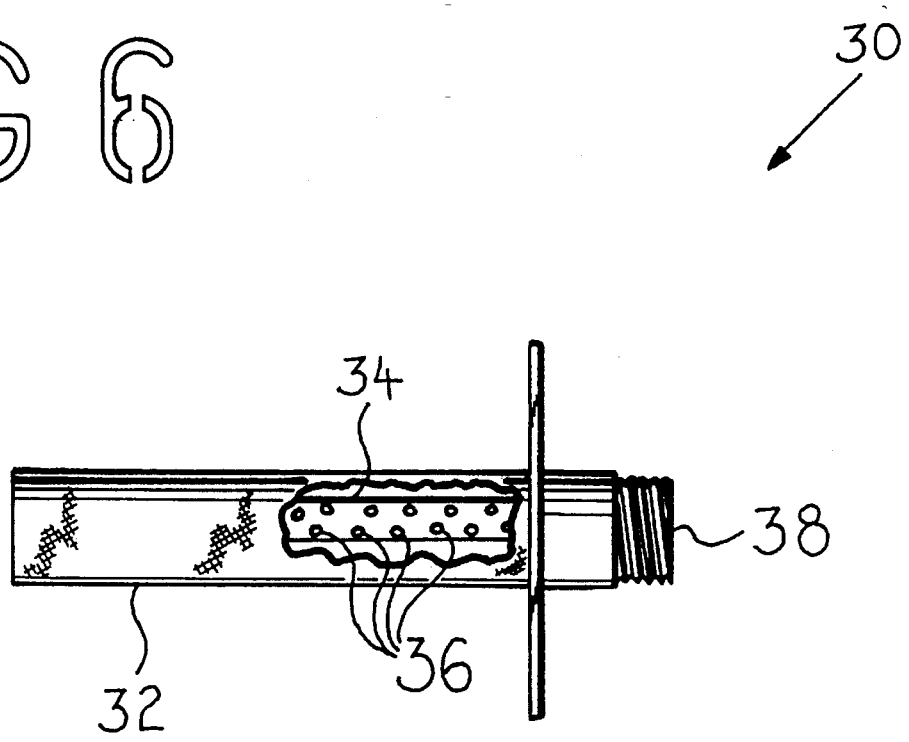
FIG. 6 is a front cut-away isometric view of a powered burner.

FIG. 6 is a from isometric cut-away view of powered burner 30. Powered burner 30 comprises powered burner inlet 38, venturi tube 34 having venturi tube holes 36, and mantle 32. Mantle 32 contains venturi tube 34, and communicates with powered burner inlet 38 through venturi tube holes 36.

Figure 4:
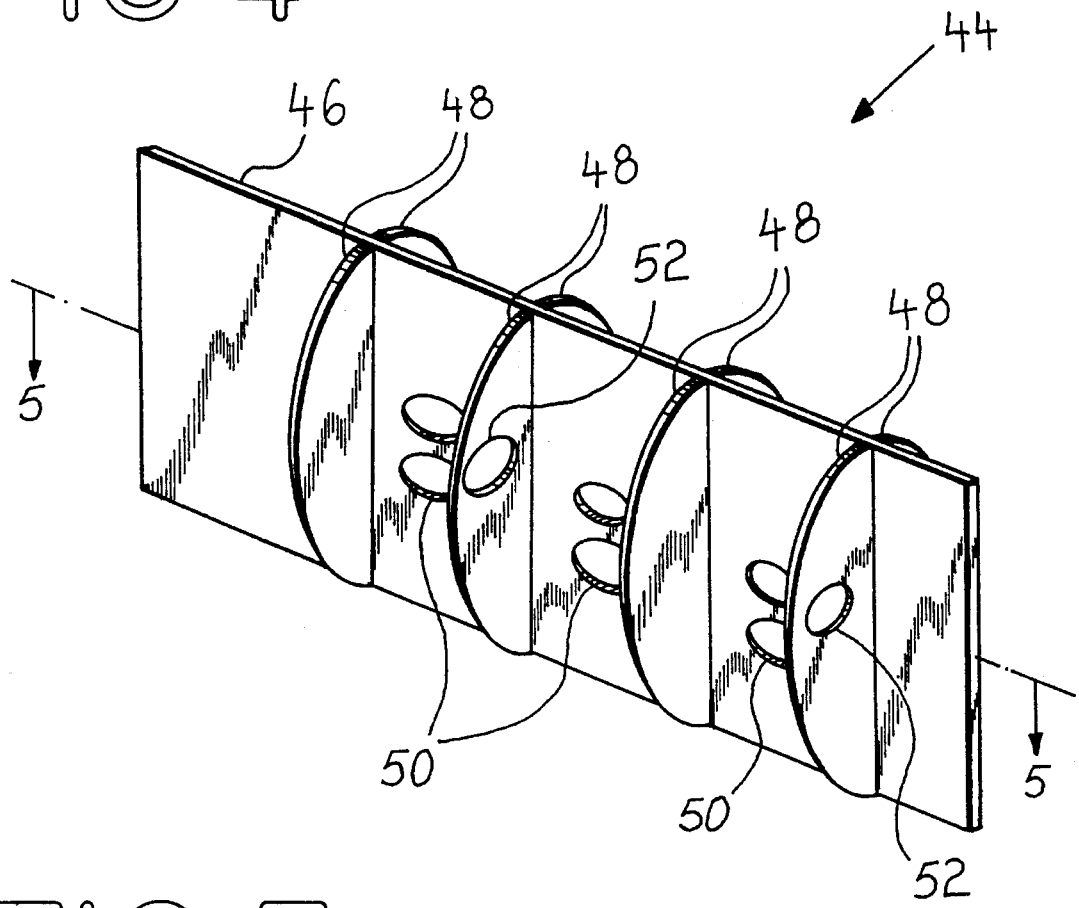
FIG. 4 is a from isometric view of a baffle.
Figure 5:
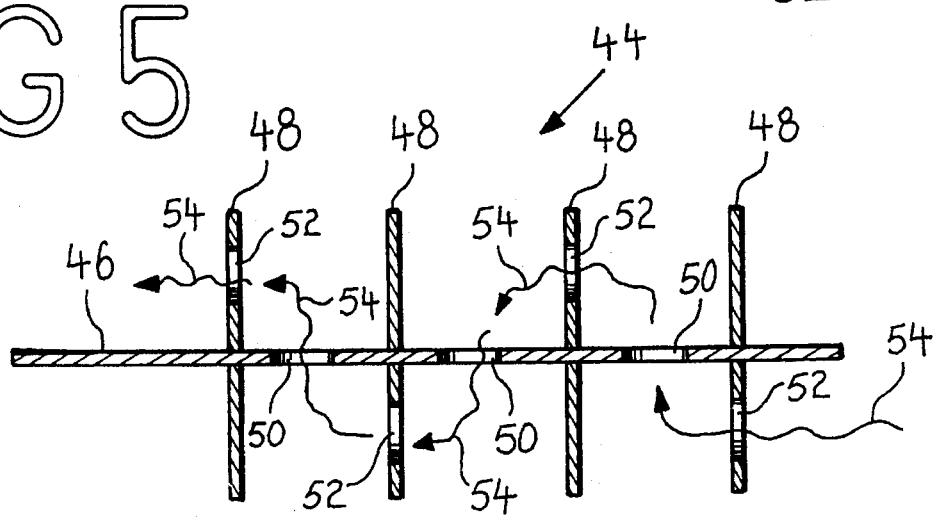
FIG. 5 is a top cross-sectional view of a baffle taken at section 5—5 of FIG. 4.

FIG. 4 is a from isometric view of baffle 44, and FIG. 5 is a top cross-sectional view of baffle 44 taken at section 5—5 of FIG. 4. Baffle 44 is comprised of ribs 48 attached to spine 46. Ribs 48 comprise fib holes 52, which are disposed on alternating sides of spine 46 in consecutive ribs 48. Spine 46 comprises spine holes 50 disposed between ribs 48. This disposition of rib holes 52 and spine holes 50 forces heated air to follow the serpentine path indicated by arrows 54. In this manner the air heated by powered burner 30 is forced to contact multiple baffle 44 heat transfer surfaces (spine 46 and ribs 48), thereby maximizing the heat transferred from the heated air to baffle 44. Heat transferred to baffle 44 subsequently transfers to inner jacket 14 via conduction, and thence to water in water jacket 17 via forced convection.

Figure 3:
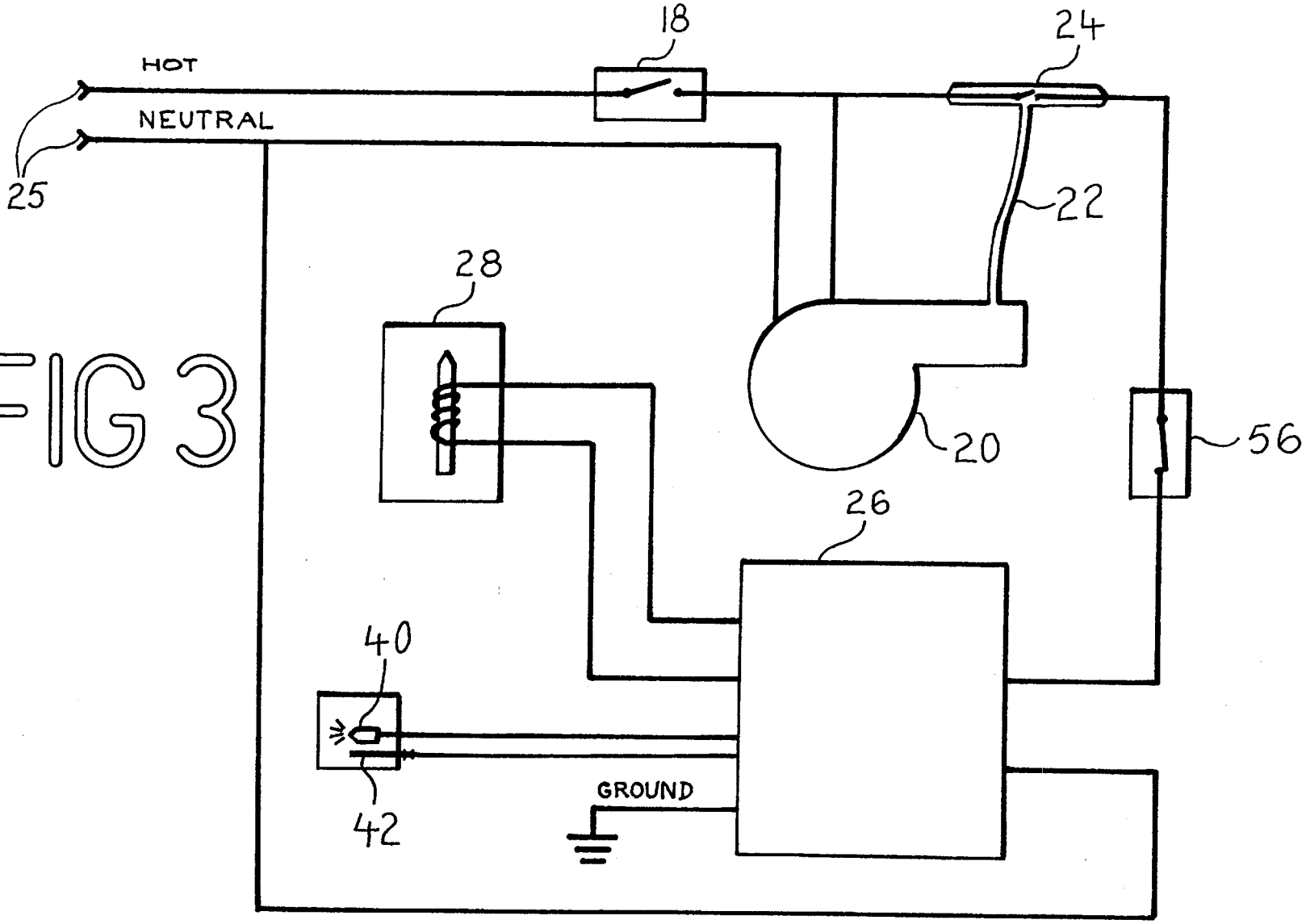
FIG. 3 is a schematic of the electrical system of an instantaneous gas water heater.

FIG. 3 is a schematic of the electrical system of instantaneous gas water heater 2. Blower 20 and a blower operation proving means such as air flow switch 24 are electrically connected to power source 25 through normally open water pressure switch 18. Normally open air flow switch 24 is electrically connected to electronic controller 26 through normally closed overheat switch 56. Gas solenoid valve 28, spark ignitor 40 and flame sensor 42 are electrically connected to electronic controller 26.

FIGS. 1, 2 and 3 may be referred to in order to illuminate the following detailed description of the operation of gas instantaneous water heater 2.

Operation

1. Faucet 16 is opened downstream of instantaneous gas water heater 2.

2. The water flow causes a drop in water pressure, which is detected by normally open water pressure switch 18, which closes, thereby powering blower 20. Blower 20 starts up, which pressurizes tube 22 to air flow switch 24.

3. The air pressure in tube 22 closes normally open air flow switch 24, which sends voltage through normally closed overheat switch 56 to electronic controller 26.

4. Electronic controller 26 sends actuation voltage (either 24 or 110 volts, depending on the specific electronic controller 26 and gas solenoid valve 28 models) to normally closed gas solenoid valve 28, which opens, thereby sending gas to powered burner 30 via gas line 58 and gas/air mixing chamber 60.

5. Electronic controller 26 instructs spark ignitor 40 to ignite, and flame sensor 42 advises electronic controller 26 when combustion is established, at which point electronic controller 26 instructs spark ignitor 40 to cease ignition. If flame sensor 42 fails to advise electronic controller 26 that combustion has been established, electronic controller 26 will instruct spark ignitor 40 to cease ignition after a predetermined period of time (e.g. 7 seconds). Depending on the specific model electronic controller 26, electronic controller 26 will re-attempt ignition for a preset number of times, and, if flame sensor 42 still senses no combustion, electronic controller 26 will terminate the ignition attempt by closing gas solenoid valve 28 and instructing spark ignitor 40 to cease ignition.

6. Once combustion is established, the combustion heats baffle 44 and inner jacket 14 via radiation and forced convection; baffle 44 heats inner jacket 14 via conduction.

7. Inner jacket 14 heats the water flowing m water sleeve 17 between inner jacket 14 and outer jacket 12 via forced convection. Combustion by-products exit combustion chamber 21 via exhaust 8.

8. Overheat Function: Normally closed overheat switch 56 monitors the temperature of water outflow 64, and opens if the water outflow 64 temperature exceeds a preset overheat temperature (e.g. 170 degrees F.). This opening of overheat switch 56 interrupts power to electronic controller 26, so electronic controller 26 ceases sending actuation voltage to normally closed gas solenoid valve 28, which closes, thereby halting combustion. When overheat switch 56 senses that water outflow 64 temperature has descended below the preset level, it closes, signaling electronic controller 26 to perform the functions of 5. supra, thereby resuming the combustion, and the instantaneous gas water heater 2 heating function.

9. When faucet 16 downstream of instantaneous gas water heater 2 closes, water pressure switch 18 opens, interrupting power to blower 20. Blower 20 ceases operating, which causes air flow switch 24 to open, thereby interrupting power to electronic controller 26. Thus deprived of power, electronic controller 26 ceases sending actuation voltage to normally closed gas solenoid valve 28, thereby causing normally closed gas solenoid valve 28 to close, ceasing combustion.

Materials, Component Parts, and Reference Specifications

Water inlet 4 and water outlet 6 may be fabricated of metal, synthetic such as PVC pipe, or other appropriate materials. Care should be taken to ensure that the temperature and pressure ratings of the material used is not exceeded. Outer jacket 12, inner jacket 14, and baffle 44 may be fabricated of metal such as copper, other metal, or other appropriate material. Outer jacket 12 may be welded to inner jacket 14 at endplates 70. Heat absorbing layer 15 may be high-temperature black paint such as 1,000 degree F. high temperature paint.

Control panel 10 may be fabricated of metal or other appropriate material, and gas/air mixing chamber may be fabricated of metal or other appropriate material. Tube 22 and gas line 58 are flexible hoses, and may be manufactured of plastic or other appropriate material.

Gas solenoid valve 28 and blower 20 are standard, commercially available items. Overheat switch 56 is a standard, commercially available item, and may be a bimetallic type overheat switch.

In the preferred embodiment, water pressure switch 18 was part number MPL-608 or MPL 628, manufactured by Micro Pneumatic Logic, inc., 2890 NW 62nd Street, Fort Lauderdale, Fla. 33309 (305)973-6166, as described in the *Micro Pneumatic Logic, inc. Catalogue* (1994) pages 1, 8 and 9, which are hereby incorporated into this specification by reference.

In the preferred embodiment, electronic controller 26 was part number MARK 10-117-3-4-4-Q-0-1-2, manufactured by Channel Products, Inc., 7100 Wilson Mills Road, Chesterland, Ohio 44026 (216)423-0113, as described in the *Gas Ignition Systems Catalogue* (Channel Products, Inc., Short Form Catalogue No. 19913, 9/92) pages 1, 4, 9, 23 and 41, which are hereby incorporated into this specification by reference. Spark ignitor 40 and flame sensor 42 are standard, commercially available items; representative depictions appear on page 41 of the *Gas Ignition Systems Catalogue.*

In the preferred embodiment, powered burner 30 was part number 62712-AC or 527152-AC, manufactured by Solaronics, Inc., P.O. Box 217 Rochester, Mich. 48308-0217 (800)223-5335, as described in the *WCF Gas-Fired Infra-Red Power Burners* descriptive bulletin (Solaronics, Inc., 1994) page 1, *Gas Fired Infra-Red Burner Design Considerations and Overview* (6 Farshid Ahmady, Solaronics, Inc., 1994) pages 449 and 455, and Solaronics, Inc. drawing no. B-0800-20-709 rev. Dec. 21, 1994, all of which are hereby incorporated into this specification by reference.

While a preferred embodiment of the invention has been illustrated hereto, it is to be understood that changes and variations may be made by those skilled in the art without departing from the spirit of the appending claims. While the instant disclosure teaches an instantaneous gas water heater 2 for me in heating hot water to be dispensed through a faucet, it is envisioned that instantaneous gas water heater 2 could be used anywhere that hot water is needed, e.g. in whirlpool baths, Jacuzzis, outdoor spas, heated swimming pools, industrial applications, commercial uses, etc., to name only a few.

DRAWING ITEM INDEX

| | |
|---|---|
| 2 | instantaneous gas water heater |
| 4 | water inlet |
| 6 | water outlet |
| 8 | exhaust |
| 9 | blower section |
| 10 | control panel |
| 11 | heat transfer section |
| 12 | outer jacket |
| 14 | inner jacket |
| 15 | heat absorbing layer |
| 16 | faucet |
| 17 | water sleeve |
| 18 | water pressure switch |
| 20 | blower |
| 21 | combustion chamber |
| 22 | tube |
| 24 | air flow switch |
| 25 | power source |
| 26 | electronic controller |
| 28 | gas solenoid valve |
| 30 | powered burner |
| 32 | mantle |
| 34 | venturi tube |
| 36 | venturi tube holes |
| 38 | powered burner inlet |
| 40 | spark ignitor |
| 42 | flame sensor |
| 44 | baffle |
| 46 | spine |
| 48 | rib |
| 50 | spine hole |
| 52 | rib hole |
| 54 | arrow |

-continued

| DRAWING ITEM INDEX | |
|---|---|
| 56 | overheat switch |
| 58 | gas line |
| 60 | gas/air mixing chamber |
| 62 | water inflow |
| 64 | water outflow |
| 66 | arrow |
| 68 | arrow |
| 70 | endplate |

I claim:

1. An instantaneous gas water heater comprising:

a control panel comprising gas solenoid valve electrically connected to an electronic controller, and a blower operation providing means electrically connected to said electronic controller;

a blower section comprising a blower electrically connected to said electronic controller, said blower communicating with a gas/air mixing chamber and with said blower operation proving means, said gas/air mixing chamber communicating with said gas solenoid valve; and a heat transfer section comprising an inner jacket, the space within said inner jacket defining a combustion chamber, a baffle disposed within said combustion chamber, a gas/air combustion means communicating with said gas/air mixing chamber disposed within said combustion chamber, an ignition means disposed within said combustion chamber, and an outer jacket enclosing said inner jacket, space between said inner jacket and said outer jacket defining a water sleeve, said gas/air combustion means comprising a powered burner comprising a venturi tube communicating with said gas/air mixing chamber, venturi tube holes in said venturi tube, and a mantle enclosing said venturi tube, the mantle's shape matching the inner jacket's shape.

2. The instantaneous gas water heater of claim 1 wherein the shape of said mantle and said inner jacket is cylindrical.

3. The instantaneous gas water heater of claim 2 wherein said mantle is manufactured of woven ceramic fiber.

4. The instantaneous gas water heater of claim 1 wherein said ignition means comprises a spark ignitor electrically connected to said electronic controller and a flame sensor electrically connected to said electronic controller.

5. An instantaneous gas water heater comprising:

a control panel comprising a gas solenoid valve electrically connected to an electronic controller, and a blower operation providing means electrically connected to said electronic controller;

a blower section comprising a blower electrically connected to said electronic controller, said blower communicating with a gas/air mixing chamber and with said blower operation proving means, said gas/air mixing chamber communicating with said gas solenoid valve; and a heat transfer section comprising an inner jacket, the space within said inner jacket defining a combustion chamber, a baffle disposed within said combustion chamber, a gas/air combustion means communicating with said gas/air mixing chamber disposed within said combustion chamber, an ignition means disposed within said combustion chamber, and an outer jacket enclosing said inner jacket, the space between said inner jacket and said outer jacket defining a water sleeve;

said baffle comprising a spine, consecutive ribs attached to said spine, spine holes in said spine disposed between said ribs, and rib holes in said ribs, said rib holes being disposed in said consecutive ribs on alternating sides of said spine.

6. The instantaneous gas water heater of claim 1 further comprising a heat absorbing layer disposed on an inside of said inner jacket, whereby the rate of heat transfer from said gas/air combustion means to said inner jacket may be increased.

7. The instantaneous gas water heater of claim 6 wherein said heat absorbing layer is comprised of high temperature paint.

8. The instantaneous gas water heater of claim 1 wherein said blower operation proving means comprises an air flow switch communicating with said blower.

9. The instantaneous gas water heater of claim 1 further comprising a water demand sensing means electrically connected to said electronic controller.

10. The instantaneous gas water heater of claim 9 wherein said water demand sensing means comprises a water pressure switch.

11. The instantaneous gas water heater of claim 1 further comprising an overheat switch thermally communicating with said outer jacket and electrically connected to said electronic controller.

12. An instantaneous gas water heater comprising:

a heat transfer section comprising a water sleeve and a combustion chamber, said combustion chamber containing a baffle, a combustion means, and an ignition means;

a blower communicating with said combustion chamber and electrically connected to an electronic controller; and a gas solenoid valve communicating with said combustion chamber and electrically connected to said electronic controller;

said baffle comprising a spine, consecutive ribs attached to said spine, spine holes in said spine disposed between said ribs, and rib holes in said ribs, said rib holes being disposed in said consecutive ribs on alternating sides of said spine.

13. The instantaneous gas water heater of claim 12 wherein said combustion means comprises a powered burner comprising a venturi tube communicating with said gas/air mixing chamber, venturi tube holes in said venturi tube, and a mantle enclosing said venturi tube.

14. The instantaneous gas water heater of claim 13 wherein said mantle is manufactured of woven ceramic fabric.

15. The instantaneous gas water heater of claim 12 wherein said ignition means comprises a spark ignitor electrically connected to said electronic controller and a flame sensor electrically connected to said electronic controller.

16. The instantaneous gas water heater of claim 5 further comprising a heat absorbing layer disposed on an inside of said inner jacket, whereby the rate of heat transfer from said gas/air combustion means to said inner jacket may be increased.

17. The instantaneous gas water heater of claim 12 further comprising a heat absorbing layer disposed on an inside of said inner jacket, whereby the rate of heat transfer from said gas/air combustion means to said inner jacket may be increased.

* * * * *

UNITED STATES PATENT AND TRADEMARK OFFICE

CERTIFICATE OF CORRECTION

PATENT NO. : 5,586,547
DATED : December 24, 1996
INVENTOR(S) : Austin D. Nixon

It is certified that error appears in the above-identified patent and that said Letters Patent is hereby corrected as shown below:

Column 1 line 31 "office" *should read* "of the"
Column 2 line 27 "art" *should read* "an"
Column 3 line 33 "from" *should read* "front"
Column 3 line 40 "from" *should read* "front"
Column 4 line 22 "from" *should read* "front"
Column 4 line 28 "from" *should read* "front"
Column 4 line 31 "fib" *should read* "rib"
Column 5 line 20 "m" *should read* "in"
Column 6 line 27 "hereto" *should read* "herein"
Column 6 line 31 "me" *should read* "use"
Column 7 line 14 "...comprising gas solenoid..." *should read* "...comprising a gas solenoid..."
Column 7 line 16 "providing" *should read* "proving"
Column 7 line 31 "...inner jacket, space..." *should read* "...inner jacket, the space..."
Column 7 line 49 "providing" *should read* "proving"

Signed and Sealed this

Eighth Day of April, 1997

*Attest:*

BRUCE LEHMAN

*Attesting Officer*

*Commissioner of Patents and Trademarks*